US006165004A

United States Patent [19]

Robinson

[11] Patent Number: 6,165,004

[45] Date of Patent: Dec. 26, 2000

[54] POWER LINE CONNECTOR/TAP SPLICE APPARATUS

[76] Inventor: Philip A. Robinson, 2515 Appaloosa Ct., Reston, Va. 20191-2111

[21] Appl. No.: 09/301,450

[22] Filed: Apr. 29, 1999

Related U.S. Application Data

[60] Provisional application No. 60/086,653, May 26, 1998.

[51] Int. Cl.[7] ..... H01R 4/24; H01R 4/26

[52] U.S. Cl. ..... 439/411; 439/415; 439/416

[58] Field of Search ..... 439/411, 413, 439/415, 414, 417, 418, 419

[56] References Cited

U.S. PATENT DOCUMENTS

| | | | |
|---|---|---|---|
| 3,094,366 | 6/1963 | Harmon, Jr. | 339/97 |
| 3,668,609 | 6/1972 | Link | 339/97 R |
| 4,050,761 | 9/1977 | De France | 339/97 R |
| 4,080,034 | 3/1978 | Werner | 339/98 |
| 4,120,554 | 10/1978 | Bianchi et al. | 339/97 R |
| 4,878,855 | 11/1989 | Heng et al. | 439/11 |

*Primary Examiner*—Michael L. Gellner
*Assistant Examiner*—Kyung S. Lee
*Attorney, Agent, or Firm*—Rodger H. Flagg

[57] ABSTRACT

A power line connector/tap splice apparatus is provided for forming an electrical connection between an electrical power cable and an electrical lead wire. A clamp assembly having a curved top plate and a V-shaped bottom plate are connected on either side of the electrical cable. The top plate is connected to an insulator body having a longitudinal passage. A conducting set screw and conducting penetrator are received in the longitudinal passage, and are advanced toward the electrical cable by an insulated hex wrench. The insulator cap is manually operable, and carries a thumb cap assembly which includes a spring which biases an end of the electrical lead wire into electrical connection with the conductive set screw. The power line connector/tap splice apparatus forms a watertight connection with the electrical power cable, and can be used to safely connect an electrical lead wire to an energized power cable without requiring an insulator blanket or insulated power gloves. The apparatus is adapted for use with various types of power cable, such as with relatively tightly or loosely wound conductors, or various cable insulations.

14 Claims, 1 Drawing Sheet

POWER LINE CONNECTOR/TAP SPLICE APPARATUS

This Application benefit to provisional Application 60/086,653 May 26, 1998.

FIELD OF THE INVENTION

The present invention relates to a method and apparatus for tapping into an electrical power cable using a power line connector or tap splice. Such power line connectors/tap splices serve as electrical cable taps, for example at construction sites, oil fields, and other places where electrical outlet sockets are not readily available.

BACKGROUND OF THE INVENTION

Where existing electrical socket connections are not provided, for example during building construction or construction in remote places, it is necessary to tap into an existing electrical power cable using a power line connector or tap splice. Examples of power line connectors/tap splices are known in the prior art, and are discussed below.

It is a problem in some of this art to provide a water-tight seal when tapping into an electrical power cable with a tap.

It is additionally a problem in some of the art to provide a tap which can be assembled with an electrical power cable without the need for insulating blankets or high voltage gloves.

Further, it is a problem in some of the art to provide a tap assembly which, when removed from the electrical power cable, requires little effort to securely repair the electrical power cable.

A hot-line connector is shown in U.S. Pat. No. 3,668,609 issued to Edwin A. Link. According to this patent, a cable connector is sealingly engaged around the outside of an insulated electrical power cable. The cable connector includes a tubular extension with a guide passage extending perpendicularly to the electrical power cable. An electrically conductive tap is crimped to a cable lead, has a pointed tip portion, and is received in the guide passage of the tubular extension. A manually-operable threaded drive assembly has a cup-shaped portion for receiving the electrically conductive tap, and has an aperture receiving a collet or split ring through which the cable lead can pass. The collet has a tapered surface receiving a washer which, when assembled with the electrically conductive tap, bears against an end of the tap. The tubular extension has an externally threaded portion which supports the manually-operable threaded drive assembly. Rotation of the manually-operable threaded drive assembly causes the collet to force the pointed tip of the electrically conductive tap through the cable insulation and into electrical contact with the electrically conductive members in the cable.

However, in U.S. Pat. No. 3,668,609 the assembly of the manually-operable threaded drive assembly, in forcing the electrically conductive tap into the cable, does not produce a sealing effect with the electrically conductive tap by the insulator body sealing around or deforming of the insulation of the electrical power cable. The sealing is by other means, however.

An electric wire connector with insulation piercing means is shown in U.S. Pat. No. 3,585,571 issued to Raymond G. Davis. In this device, a block of insulating material has two grooves for receiving main electrical power cable wires. First and second bores in the block communicate respectively with the two grooves. The bores are substantially identical. The first bore receives at one end thereof a bolt or screw. An electrically conductive tap is loosely received in a portion of the first bore, and has a head which can be urged by the bolt or screw into the electrical power cable. An electrical lead disposed between the head of the electrically conductive tap and the end of the bolt or screw, so that it remains in electrical contact with the electrically conductive tap. The bolt or screw must be composed of insulating material.

However, in the above-discussed U.S. Pat. No. 3,585,571, there is no insulation at the point of penetration of the electrically conductive tap into the electrical power cable. Furthermore, a water-tight connection is not formed by the assembly of this patent. Additionally, if the bolt or screw works loose, electrical connection can be lost between the electrical lead wire and the electrically conductive tap, and water can penetrate to the electrically conductive tap. Further, the assembly is not adapted for use with a variety of types of insulated electrical power cables such as loosely woven or tightly woven electrical power cables. Also, in forcing the electrically conductive tap into the cable, the assembly does not produce a sealing effect with the electrically conductive tap by the insulator body sealing around or deforming the insulation of the electrical power cable.

A cup-shaped underground tap connector is shown in U.S. Pat. No. 4,050,761 issued to Robert V. De France. The connector has a piercing member and a clamping assembly for bringing the piercing member into tight engagement with an electrical power cable. The clamping assembly includes a top plate and a bottom plate arranged on opposite sides of the electrical power cable, and are tightened together by a pair of threaded bolts or screws. The top plate has an aperture receiving a body which carries the piercing member and an electrical lead wire. The electrical lead wire is connected to the body by a pair of set screws. A disc-like sealing pad is disposed at the point of contact of the electrical power cable and the body carrying the piercing member, and the piercing member extends through the sealing pad.

However, in the above-discussed U.S. Pat. No. 4,050,761, the assembly, in forcing the electrically conductive tap into the cable, does not produce a sealing effect with the electrically conductive tap by the insulator body sealing around or deforming the insulation of the electrical power cable.

In U.S. Pat. No. 3,461,419, a hot line connector is shown which includes a cable tap having a penetrating needle, and a clamping assembly having a portion which supports and guides the cable tap. The clamping assembly is formed by two mating parts having undulating mating surfaces. The portion which supports and guides the cable tap includes a housing having an insulator at one end, the insulator including hinged overlapping sections forming a passage for the cable tap. The cable tap is connected fixedly to an electrical lead wire, and is carried by a support member having a beveled end. A threaded collar member is engageable with the housing, and bears against a washer. The washer in turn bears against a flange, which in turn bears against the beveled end of the support member carrying the cable tap. Manual rotation of the threaded collar member forces the pointed end of the cable tap through the insulation of the electrical power cable. It seals by other means, however.

However, in U.S. Pat. No. 3,461,419 the cable tap assembly is fixedly connected to the electrical lead cable, has a fixed penetration depth due to the shape of tip, and is not adapted for use with a variety of types of insulated electrical power cables such as loosely woven or tightly woven electrical power cables. Furthermore, in this patent the assembly of the manually-operable threaded drive assembly, in forcing the electrically conductive tap into the cable, does not produce a sealing effect with the electrically conductive tap by deformation of the insulation of the electrical power cable.

An electric test clamp is shown in U.S. Pat. No. 3,094,366 issued to J. R. Harmon, Jr. This device includes a main body member attached by a band to an electrical power cable. The main body member has a threaded passage for receiving a threaded member carrying a pointed cable tap. The main body member also has a hollow interior with a spring member therein for urging a movable plate against a bottom portion of the main body member. An electrical lead wire is connected atop the main body, and is retained there by the head of the cable tap. The electrical lead wire is thereby left exposed.

However, in U.S. Pat. No. 3,094,366, the cable tap assembly is electrically exposed, and the head of the cable tap is electrically exposed. Also, the cable tap has a limited depth to which it can be inserted into the electrical power cable due to the presence of the head of the cable tap, and is therefore not adapted for use with a variety of types of insulated electrical power cables such as loosely woven or tightly woven electrical power cables. Furthermore, a watertight connection is not formed by the assembly according to this patent. Also, during assembly, high voltage gloves should be worn since conductive portions remain exposed and would be dangerous whether or not wet.

SUMMARY OF THE INVENTION

An object of the present invention is to provide a power line connector/tap splice apparatus which is convenient to use.

Another object of the present invention is to provide a power line connector/tap splice apparatus which forms a watertight connection with an electrical power cable.

A further object of the present invention is to provide a power line connector/tap splice apparatus which can be used to safely connect an electrical lead wire to an energized power cable without requiring the use of an insulator blanket or insulated power gloves.

Another object of the present invention is to provide a power line connector/tap splice apparatus which is adapted for use with various types of power cable, such as with relatively tightly or loosely wound conductors, or various insulation types.

These objects are accomplished by provision of a power line connector having an insulator body, a conducting set screw, a conducting penetrator connected to the conducting set screw, a thumb cap assembly, and a clamp assembly to secure the conducting penetrator to an electrical power cable. The thumb cap assembly connects an electrical lead wire to the conducting set screw and thereby to the conducting penetrator, to carry electrical power from the electrical power cable.

More specifically, in the present invention, the clamp assembly includes a curved top plate and a V-shaped bottom plate connected by a pair of screws, to clamp an electrical cable. The thumb cap assembly is connected by threaded engagement with the insulator body, and is thereby manually operable to electrically connect the electrical lead wire to the conductive set screw. The thumb cap assembly includes a nylon sleeve with a collar, an O-ring, a washer, a disc, and a spring which biases the disc against the conductive set screw. The electrical lead wire passes through an aperture in the insulator cap.

The insulator body has an upper threaded portion for connection with the thumb cap assembly, a lower threaded portion for connection with the curved top plate, and a longitudinal passage therethrough to receive the conducting set screw. A portion of the longitudinal passage is threaded, to engage corresponding threads on the conducting set screw.

The conducting penetrator has a threaded portion for engagement with the threaded portion of the longitudinal passage, and a penetrator tip which penetrates through the insulation of the electrical power cable.

In use, the clamp assembly is clamped to an electrical power cable. A strip of putty can optionally be placed on the electrical power cable where the insulator body is to be placed, and the insulator body is threaded into the curved top plate. The conducting set screw bearing the conducting penetrator is then inserted into the insulator body, and tightened by use of an insulated wrench. The thumb cap assembly is then fastened over the end of the insulator body such that the disc is biased against the top of the conducting set screw.

Upon removal of the clamp assembly from the electrical power cable, only a small opening remains in the insulation sheath of the electrical power cable. This opening can be readily repaired, by known methods such as electrical tape or sealing putty.

Other objects and advantages of the present invention will be more readily apparent from the following detailed description when read in conjunction with the accompanying drawings.

DETAILED DESCRIPTION OF THE INVENTION

Figure 1:
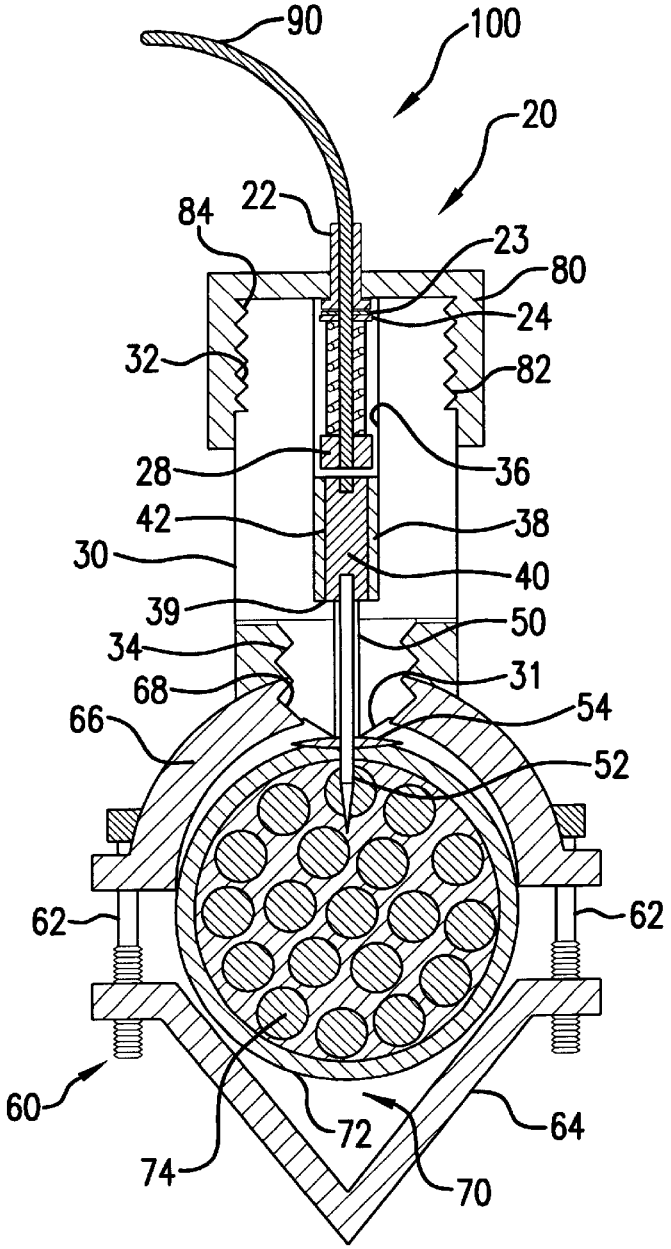
FIG. 1 is a side sectional view of the power line connector/tap splice apparatus according to the present invention.
Figure 2:
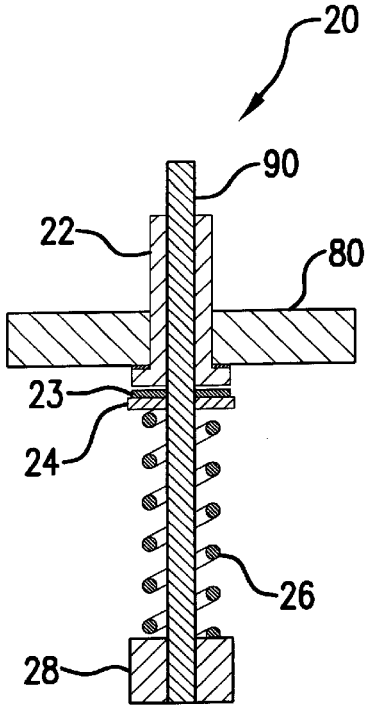
FIG. 2 is an enlarged view of a thumb cap assembly shown in FIG. 1.

A power line connector/tap splice apparatus 100 is shown in FIG. 1, and is used for electrically connecting an electrical lead wire 90 to an electrical power cable 70. The electrical power cable 70 has an insulating sheath 72 covering conductor 74. (Note: the cable is a single conductor). The power line connector/tap splice apparatus 100 includes an insulator cap 80, a thumb cap assembly 20, an insulator body 30, a conducting set screw 40, a conducting penetrator 50, and a clamp assembly 60 which secures the insulator body 30 and the conducting penetrator 50 to the electrical power cable 70.

The insulator cap 80 is connected to the insulator body 30 by threaded engagement with an upper threaded portion 32 of the insulator body 30. The insulator cap 80 has an aperture therein which receives and carries the thumb cap assembly 20. The electrical lead wire 90 is carried by the thumb cap assembly 20, and passes through the aperture in the insulator cap 80.

The thumb cap assembly 20 includes a sleeve 22, made of an electrically insulating material, having a collar. The sleeve 22 being fixed to the insulator cap 80. The electrical lead wire 90 slidably passes through a longitudinal passage in the sleeve 22. The thumb cap assembly 20 also includes an O-ring 23 disposed between the collar of the sleeve 22 and a washer 24. The washer 24 forms an abutment surface for one end of a spring 26. The spring 26 has another end abutting a disc 28 which is fixedly connected to the end of the electrical lead wire 90. The spring 26 resiliently urges the disc 28 away from the washer 24, so that the disc 28 is urged against the conductive set screw 40.

The insulator body 30 has a longitudinal passage 36 therethrough to receive the conducting set screw 40. A portion 38 of the longitudinal passage 36 is threaded, to engage corresponding threads 42 on the conducting set screw 40. The insulator body 30 has, in addition to the above-mentioned upper threaded portion 32, a lower threaded portion 34 for engagement with a curved top plate 66 of the clamp assembly 60.

The longitudinal passage 36 of the insulator body 30 narrows to form an abutment ledge 39. Preferably, the insulator body 30 is tapered or otherwise beveled 31 at the point where it meets the cable insulation 72 or an optional putty strip 54. The tapered end 31 allows the insulator body to press deeper into the conductor insulation to form a better seal around the conducting penetrator 50.

The conducting set screw 40 is formed as a generally cylindrical body having a threaded portion 42 for engagement with the threaded portion 38 of the insulator body 30. The conducting set screw 40 has a top surface having a recess for a tool head, such as a hexagonally shaped recess for receiving the head of a wrench. The wrench, not shown, should be electrically insulated to prevent shock. The conducting set screw 40 has a recess in the lower portion thereof receiving an upper portion of the conducting penetrator 50. The conducting penetrator 50 is preferably soldered or pressed into the recess of the conducting set screw 40, so as to be fixedly connected thereto. The conducting penetrator 50 includes an extended (sharpened) penetrator tip 52 which penetrates through the insulating sheath 72 and into the conductors 74 of the electrical power cable 70.

The clamp assembly 60 includes the curved top plate 66, a V-shaped bottom plate 64, and a pair of screws 62, 62 on either side of the electrical power cable 70 for connecting the curved top plate 66 to the bottom plate 64. The curved top plate 66 has a threaded aperture 68 therein which receives the lower threaded portion 34 of the insulator body 30. The screws 62, 62 are tightened sufficiently to forcibly clamp the electrical power cable 70 between the curved top plate 62 and the bottom plate 64.

In use, the clamp assembly 60 is first clamped to the electrical power cable 70. An insulated putty strip 54 can optionally be placed on the electrical power cable 70 where the insulator body 30 is to be placed, and the insulator body 30 is threaded into the curved top plate 66. The conducting set screw 40, bearing the conducting penetrator 50, is then inserted into the insulator body 30, and tightened by use of the insulated wrench. The thumb cap assembly 20 and the insulator cap 80 are then fastened over the upper end of the insulator body 30 such that the disc 28 is biased against the top of the conducting set screw 40.

Upon removal of the clamp assembly 60 from the electrical power cable 70, only a small opening remains in the insulation sheath 72 of the electrical power cable 70. This opening can be readily repaired using known materials and methods, for example electrical tape or sealing putty.

The invention being thus described, it will be evident that the same may be varied in many ways. Such variations are not to be regarded as a departure from the spirit and scope of the invention and all such modifications are intended to be included within the scope of the claims.

What is claimed is:

1. An apparatus for electrically connecting an electrical lead wire to an electrical power cable, comprising:

a) a clamp assembly with a curved top plate having an aperture with internal threads extending therethrough, the clamp assembly further having a V-shaped bottom plate adjustably secured to the curved top plate with screws; the curved top plate and V-shaped bottom plate of the clamp assembly sized to encircle and clamp to the electrical power cable;

b) an electrical lead wire, c) an insulator body having an upper external threaded portion and a lower external threaded portion, the lower external threaded portion threadably received within the internal threads in the curved top plate of the clamp assembly, the insulator body further having a stepped, longitudinal bore passage extending through the insulator body, the lower end of the stepped longitudinal bore passage having an internal threaded portion therein;

d) a conducting set screw in electrical contact with the lead wire, the conducting set screw having an external threaded portion sized to be threadably received in the internal threaded portion of a lower end of the stepped longitudinal bore passage, the conducting set screw further having a penetrator with a pointed penetrator tip extending from the conducting set screw, the pointed penetrator tip for penetrating through the insulating sheath surrounding the electrical power cable to physically contact the conductors extending through the electrical power cable, and e) an insulator cap having internal threads sized to threadably engage the upper external threads on the insulator body, the insulator cap having an aperture extending through the insulator cap in alignment with the longitudinal passage in the insulator body, the insulator cap further having a sleeve with a collar, the sleeve sized to closely receive the electrical lead wire therethrough, and an O-ring seal to provide a water tight seal between the electrical lead wire and the insulator cap.

2. An apparatus as claimed in claim 1, wherein the insulator body is cylindrical in shape, and has a projecting portion having a tapered end positioned for contact with the electrical cable.

3. An apparatus as claimed in claim 1, further comprising a conductive disk secured to a distal end of the electrical lead wire, and a spring disposed about the electrical lead wire to bias the conductive disk in abutting contact with the conducting set screw.

4. An apparatus as claimed in claim 1, further comprising a brass washer positioned between the spring and the O-ring seal, the brass washer in engagement with the spring to bias the O-ring against the collar of the sleeve to further ensure a water-tight seal between the electrical power cable and the electrical wire lead.

5. An apparatus as claimed in claim 1, further comprising a putty strip disposed about the conducting penetrator, between an insulating sheath of the electrical power cable and the insulator body.

6. An apparatus for electrically connecting an electrical lead wire to an electrical power cable, comprising:

a) a clamp assembly with a curved top plate having an aperture with internal threads extending therethrough, the clamp assembly further having a V-shaped bottom plate adjustably secured to the curved top plate with screws; the curved top plate and V-shaped bottom plate sized to encircle and clamp the clamp assembly to the electrical power cable;

b) an electrical lead wire, c) an insulator body having an upper external threaded portion and a lower external threaded portion, the lower external threaded portion threadably received within the internal threads in the curved top plate of the clamp assembly, the insulator body further having a stepped, longitudinal bore passage extending through the insulator body, the lower end of the stepped longitudinal bore passage having an internal threaded portion therein;

d) a conducting set screw in electrical contact with the lead wire, the conducting set screw having an external threaded portion sized to be threadably received in the internal threaded portion of a lower end of the stepped longitudinal bore passage, the conducting set screw further having a penetrator with a pointed penetrator tip extending from the conducting set screw, the pointed penetrator tip for penetrating through the insulating sheath surrounding the electrical power cable to physically contact the conductors extending through the electrical power cable, e) an insulator cap having internal threads sized to threadably engage the upper external threads on the insulator body, the insulator cap having an aperture extending through the insulator cap in alignment with the longitudinal passage in the insulator body, the insulator cap further having a sleeve with a collar, the sleeve sized to closely receive the electrical lead wire therethrough, and an O-ring seal to provide a water tight seal between the electrical lead wire and the insulator cap; and a conductive disk secured to a distal end of the electrical lead wire, and a spring disposed about the electrical lead wire to bias the conductive disk in abutting contact with the conducting set screw.

7. An apparatus as claimed in claim 6, wherein the conducting set screw is adjustably received in the insulating body, so that the depth to which the conducting penetrator extends into the power cable is adjustable.

8. An apparatus as claimed in claim 6, wherein the conducting penetrator has a sharply pointed penetrator tip portion.

9. An apparatus as claimed in claim 6, further comprising a brass washer positioned between the spring and the O-ring seal, the brass washer in engagement with the spring to bias the O-ring against the collar of the sleeve to further ensure a water-tight seal between the electrical power cable and the electrical wire lead.

10. An apparatus as claimed in claim 6, further comprising a brass washer positioned between the spring and the O-ring seal, the brass washer in engagement with the spring to bias the O-ring against the collar of the sleeve to further ensure a water-tight seal between the electrical power cable and the electrical wire lead.

11. An apparatus as claimed in claim 6, further comprising a putty strip disposed about the conducting penetrator, between an insulating sheath of the electrical power cable and the insulator body.

12. An apparatus for electrically connecting an electrical lead wire to an electrical power cable, comprising:

a) a clamp assembly with a curved top plate having an aperture with internal threads extending therethrough, the clamp assembly further having a V-shaped bottom plate adjustably secured to the curved top plate with screws; the curved top plate and V-shaped bottom plate sized to encircle and clamp to the electrical power cable;

b) an electrical lead wire, c) an insulator body having an upper external threaded portion and a lower external threaded portion, the lower external threaded portion threadably received within the internal threads in the curved top plate of the clamp assembly, the insulator body further having a stepped, longitudinal bore passage extending through the insulator body, the insulator body receiving the lead wire through an upper end of the stepped longitudinal passage, the lower end of the stepped longitudinal bore passage having an internal threaded portion therein;

d) a conducting set screw in electrical contact with the lead wire, the conducting set screw having an external threaded portion sized to be threadably received in the internal threaded portion of a lower end of the stepped longitudinal bore passage, the conducting set screw further having a penetrator with a pointed penetrator tip extending from the conducting set screw, the pointed penetrator tip for penetrating through the insulating sheath surrounding the electrical power cable to physically contact the conductors extending through the electrical power cable, e) an insulator cap having internal threads sized to threadably engage the upper external threads on the insulator body, the insulator cap having an aperture extending through the insulator cap in alignment with the longitudinal passage in the insulator body, the insulator cap further having a sleeve with collar, the sleeve sized to closely receive the electrical lead wire therethrough, and an O-ring seal to provide a water tight seal between the electrical lead wire and the insulator cap;

f) a conductive disk secured to a distal end of the electrical lead wire, and a spring disposed about the electrical lead wire to bias the conductive disk in abutting contact with the conducting set screw; and g) a brass washer positioned between the spring and the O-ring seal, the brass washer in engagement with the spring to bias the O-ring against the collar of the sleeve to further ensure a water-tight seal between the electrical power cable and the electrical wire lead.

13. An apparatus as claimed in claim 12, further comprising a putty strip disposed about the conducting penetrator, between an insulating sheath of the electrical power cable and the insulator body.

14. An apparatus as claimed in claim 12, wherein the conducting set screw is adjustably received in the insulating body, so that the depth to which the conducting penetrator extends into the power cable is adjustable.

* * * * *